United States Patent [19]

Pisarski et al.

[11] 4,000,812

[45] Jan. 4, 1977

[54] CADDY FOR CIGARETTES AND THE LIKE

[76] Inventors: Arthur J. Pisarski; Margaret Pisarski, both of c/o MACH II, Oak and Astor Sts., Monee, Ill. 60449

[22] Filed: Aug. 20, 1975

[21] Appl. No.: 606,169

[52] U.S. Cl. ..... 206/87; 206/268; 206/270; 220/69; 220/329; 220/336

[51] Int. Cl.[2] ..... A24F 15/10

[58] Field of Search ..... 206/85, 86, 87, 88, 206/267, 268, 248, 270; 220/69, 356, 352, 337, 336, 329

[56] References Cited

UNITED STATES PATENTS

| | | | |
|---|---|---|---|
| 365,232 | 6/1887 | Bingham | 220/329 |
| 1,293,197 | 2/1919 | Rice | 206/88 |
| 1,815,069 | 7/1931 | Petro | 206/267 |
| 1,846,275 | 2/1932 | Palanjian | 206/87 |
| 1,970,158 | 8/1934 | Williams | 206/88 |
| 2,460,427 | 2/1949 | Musselman et al. | 206/89 |
| 2,475,896 | 7/1949 | Husted | 206/267 |
| 3,081,867 | 3/1963 | Corey | 206/248 |
| 3,811,004 | 5/1974 | Moore | 220/337 |

FOREIGN PATENTS OR APPLICATIONS

| | | | |
|---|---|---|---|
| 1,071,803 | 1964 | United Kingdom | 220/336 |

*Primary Examiner*—William Price
*Assistant Examiner*—Joseph M. Moy
*Attorney, Agent, or Firm*—Olson, Trexler, Wolters, Bushnell & Fosse, Ltd.

[57] ABSTRACT

A caddy for carrying a package of cigarettes and a cigarette lighter is disclosed. The caddy includes a housing having a cross sectional shape and area adapted to snugly receive the corresponding cross sectional shape and area of the cigarette package. The housing top is formed with a hole located to be superimposed over a hole in the enclosed cigarette package. A cover is carried by the caddy for covering and uncovering this housing top hole, and an actuator surface on the cover is adapted for engagement by a digit of the single hand holding the caddy. A movable bottom covers and uncovers the housing bottom to permit a cigarette package to be inserted or withdrawn. A pincer retainer at one of the two opposed small caddy sides includes two spaced apart resilient pincer arms extending toward one another to accommodate and resiliently retain the cigarette lighter on and in the caddy in a position to permit ignitive operation of the lighter by the thumb of the hand which holds the caddy.

7 Claims, 4 Drawing Figures

CADDY FOR CIGARETTES AND THE LIKE

BACKGROUND OF THE INVENTION

This invention relates generally to a caddy for retaining and carrying a package of cigarettes and an associated cigarette lighter.

Holders or retainers for cigarette packages have attained wide popular appeal for a number of reasons. Many of these package holders provide an attractive appearance. Some assist in retaining and keeping tidy the inevitable tobacco shreads and other mess attendant with cigarette packages. Some retainers also assist in preventing the retained cigarette package from being crushed or otherwise damaged.

It is the general object of the present invention to provide a handy yet compact caddy or retainer for a cigarette package and an associated lighter.

It is a more specific object of the invention to provide a cigarette package and lighter caddy which discourages or eliminates the loss or separation of the lighter from the cigarette package.

It is another object to provide a cigarette package and lighter caddy which permits a smoker to draw a cigarette from the retained package and light the cigarette with but a few simple motions of that single hand which holds the caddy.

It is yet another object to provide a caddy which inhibits the ingress of moisture and cigarette contaminants, and inhibits the egress of tobacco shreds or flakes and attendant mess with improved effectiveness. A related object is to prevent inadvertent crushing or damage of either cigarette package or cigarette lighter with increased effectiveness.

Other objects and advantages of the invention will become apparent upon reading the following detailed description and upon reference to the drawings. Throughout the description, like reference numerals refer to like parts.

DETAILED DESCRIPTION

Figure 1:
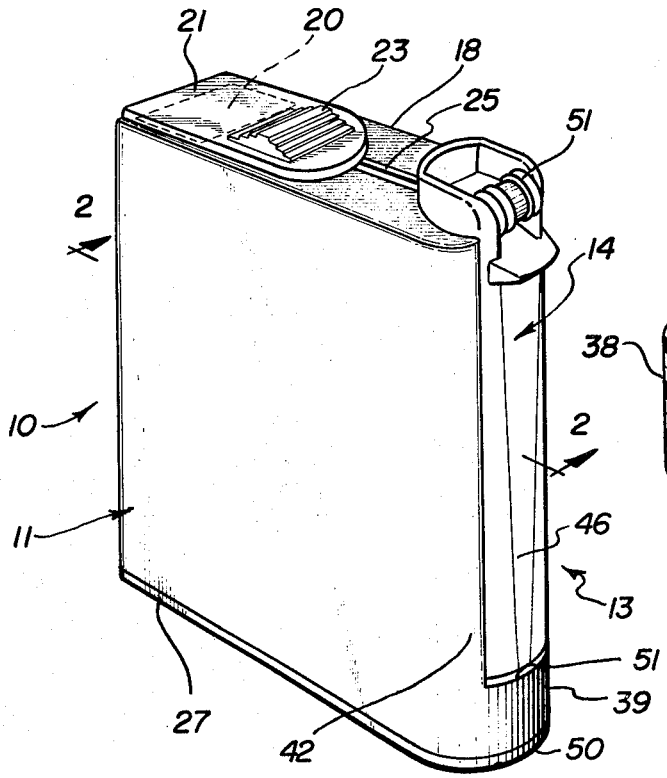
FIG. 1 is a perspective view showing the novel cigarette caddy in its general aspect.

While the invention will be described in connection with a preferred embodiment, it will be understood that it is not intended to limit the invention to this embodiment. On the contrary, it is intended to cover all alternatives, modifications, and equivalents as may be included within the spirit and scope of the invention.

More specifically, the drawings show a cigarette caddy 10 embodying the present invention. In general, this caddy 10 can be considered to include an enclosed cigarette housing portion 11 for retaining a cigarette package 12 and a pincer-like cigarette lighter retainer portion 13 for retaining a cigarette lighter 14. The caddy can be molded or otherwise formed from a polyolefin resin stock of known composition.

Figure 3:
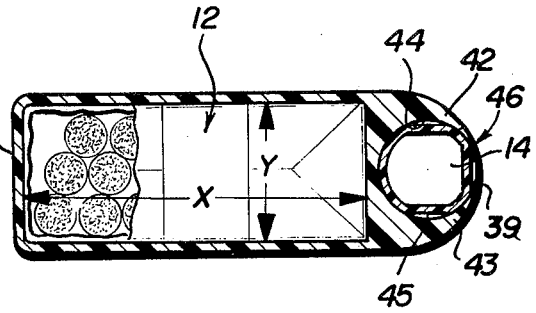
FIG. 3 is a sectional view taken substantially in the plane of line 3—3 in FIG. 2 and showing further details of the caddy.
Figure 4:
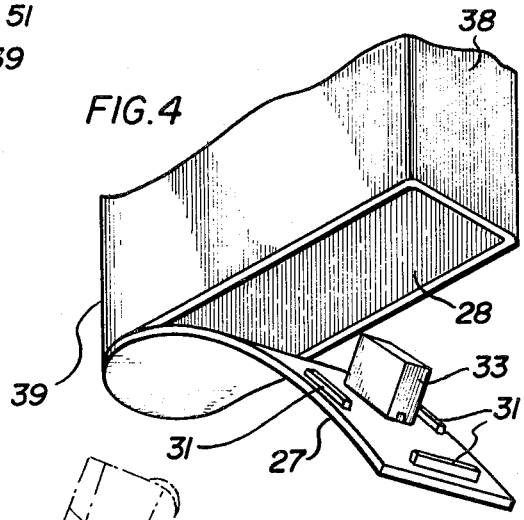
FIG. 4 is a fragmentary perspective view showing the caddy bottom and associated structure.

The housing portion 11 is provided with an interior cross sectional area having a relatively large length X and a relatively small width Y adapted to snugly accommodate the corresponding cross sectional area of the cigarette package 12 as shown especially in FIG. 3. The depth of the housing portion Z is sufficient to accommodate the corresponding depth of a cigarette of extended length, such as a king size cigarette package. It will be understood that the caddy could be formed to accommodate other cigarette packages such as packages containing cigarettes of the "100's" length.

The caddy is provided with a housing top 18 having formed therein a hole 20 shaped and located to be superimposed over the standard cigarette package hole which is formed by the smoker in tearing away the usual portion of paper defining part of the cigarette package top. Thus, appropriate tapping, shaking or other manipulation of the cigarette caddy 10 and contained cigarette package 12 causes partial ejectment of a cigarette from the package 12 through the housing hole 20. The cigarette can then be grasped with the lips and easily withdrawn in known manner.

To retain cigarette tobacco shreads within the caddy and to discourage the ingress of moisture or other cigarette contaminents, a movable cover 21 is carried by the caddy top 18 for covering and uncovering the housing top hole 20. In accordance with one aspect of the invention, therefore, this cover can be opened and closed by a thumb or other digit of the hand which holds the caddy 10 itself. To this end, an actuator surface 23 formed or otherwise provided on the cover is oriented and adapted for actuation by a digit of a hand holding the caddy. In the illustrated embodiment, this aggressive actuator surface 23 is located on an interior or relatively central portion of the cover 21 to permit easy actuation of the cover when the caddy is held in a single hand in any of the several positions. It is a feature of the invention that this actuation can be accomplished in a simple and easy manner; to permit this, the housing top 18 and cover 21 are provided with mating slide surfaces 25 and 26, respectively. These elongated surfaces retain the cover 21 on the housing top 18 and permit the cover to be moved with translational motion.

To allow a cigarette package 12 to be inserted into or withdrawn from the caddy, a movable bottom 27 is carried by the caddy 10 for covering and uncovering an opening 28 in the housing base. In the illustrated embodiment of this invention, mating circular guide surfaces 29 and 30 are formed in the housing 11 and bottom 27 respectively to permit the bottom 27 to be rotated into and out of the package-retaining position or to alternatively permit the bottom 27 to be completely detached from and reinstalled upon the caddy. If desired, retainer stops 31 can be provided to engage the bottom extremities of the housing 11 to further assist in retaining this bottom 27 in its closed position on the caddy.

In accordance with another aspect of the invention, even regular size cigarette packages can be conveniently accommodated within this caddy. To this end, a spacer 33 is carried by the bottom 27 and is of such dimensions as to permit it to engage the bottom 34 of a regular size cigarette package 12. When so engaged, this spacer 33 positions a top 35 of the cigarette package 12 adjacent the caddy housing top 18 and housing top hole 20. To permit alteration of the caddy to accommodate longer cigarette packages, the spacer 33 is removably attached to the bottom 28 by interengagement of lands and grooves 29 and 30 or other interlocking structure.

As explained above, it is an important feature of this invention that the caddy retains a cigarette lighter 14 in a position relative to the cigarette package and so oriented as to enable the cigarette lighter to be operated by a digit of the hand holding the caddy, i.e., the cigarette can be extracted from the caddy and lit by the caddy-retained lighter all by using but a single hand. To this end, a pincer retainer structure is formed at one end of the two opposite small caddy sides 38 and 39. This retainer 13 includes two pincer arms 42 and 43 extending toward one another as illustrated. Resilient inner arm surfaces 44 and 45 are formed in extent and configuration for accommodating and resiliently retaining a cigarette lighter 14 of predetermined size and shape. In the illustrated instance, this cigarette lighter takes the form of a roughly cylindrical lighter marketed under the trade name "Cricket" by the Gillette Corporation of Boston, Massachusetts.

Figure 2:
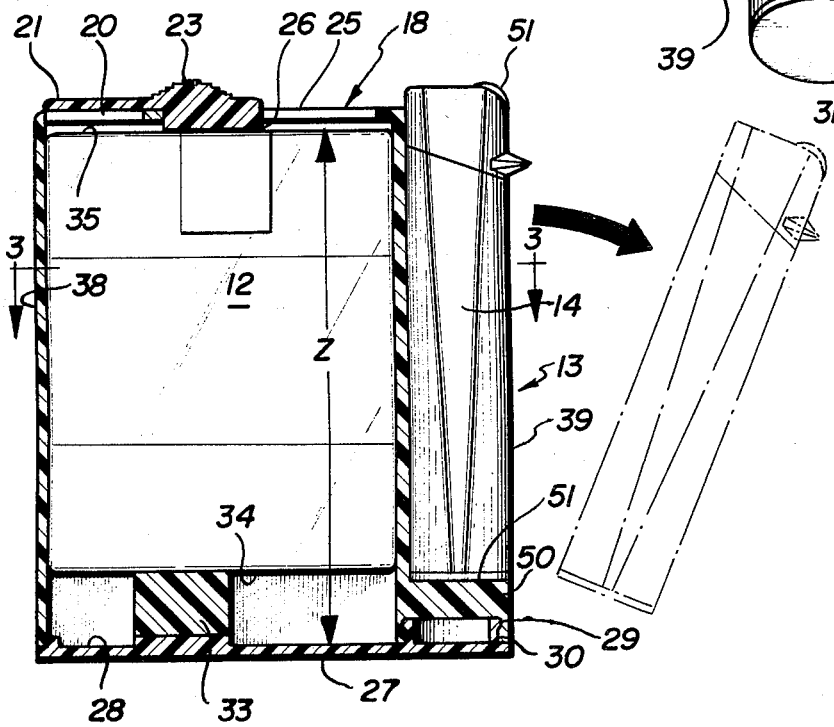
FIG. 2 is an elevational view in section taken substantially in the plane of line 2—2 in FIG. 1 and showing in further detail the construction of the caddy.

It is, of course, desirable that the lighter 14 be easily yet firmly installed in the caddy 10, but nevertheless be easily removed as indicated in FIG. 2 for replacement or servicing when desired. To this end, the two pincer arms 42 and 43 and their inner surfaces 44 and 45 are formed substantially in the form of a circular right cylinder interrupted along its axial length by a slot 46. To provide adequate retentive action, yet permit relatively easy arm motion when removal of the lighter is desired, this slot subtends an arc of more than 15°, yet substantially less than 130°. Outer arm surfaces 47 and 48 flare smoothly into the outer surfaces 49 of the package housing 11 to form a smooth, easily handled, easily pocketed caddy.

Since the cigarette lighter 14 may have a length shorter than the overall depth of the caddy 10, a supporting spacer structure 50 is provided under the lighter 14 and forms a pocket bottom 51 to locate the lighter 14 on the package with the lighter in the illustrated position so as to permit its easy operation. Here, lighter ignition structure 51 projects above the caddy top 18 to encourage easy and positive lighter operation. To insure that the bottom 27 pivots sufficiently to completely expose the hole 28, and the interior of the housing 11, the circular guide surfaces 29 and 30 are carried in the spacer structure 50 at a position offset from the hole 28 and below the pincer arms 42 and 43.

Use of the caddy with but a single hand is easy. The caddy can be gripped with the fingers of one hand curled around either of the small caddy sides 38 or 39. The thumb of the same hand can then open the caddy cover 21, and a cigarette can be extracted as explained above. The thumb can then move to the lighter ignitive structure 51 to operate the lighter 14 and light the cigarette.

The invention is claimed as follows:

1. A caddy for carrying a package of cigarettes or the like having a predetermined outer size and shape and a cigarette lighter of predetermined outer size and shape, comprising, in combination, an enclosed cigarette package housing having an inner cross sectional area of relatively large length and relatively small width adapted to snugly accommodate the corresponding cross sectional area of a cigarette package, and having a depth sufficient to accommodate the corresponding depth of a cigarette package of extended length, a housing top formed with a hole shaped and located to be superimposed over a standard cigarette package hole, a movable cover carried by the caddy for covering and uncovering the housing top hole, an actuator surface on the cover oriented and adapted for engagement and cover actuation by a digit of a hand holding the caddy, a movable bottom carried by the housing for covering and uncovering the housing bottom to permit a cigarette package to be inserted into or withdrawn from the caddy, a pincer retainer integral with and located at one of the two opposed small housing sides, the retainer including at least two spaced apart resilient pincer arms extending toward one another and having inner surfaces for accommodating and resiliently retaining a cigarette lighter of predetermined shape and size on and in the caddy in a position to permit ignitive operation of the lighter by a digit of the hand holding the caddy fixed retainer bottom means integral with and extending laterally from said one housing side beneath said pincer arms and complementary interconnecting means on said movable bottom and said fixed bottom means for connecting said movable bottom with said housing, wherein said interconnecting means comprises mating, pivotable, detachable surfaces, the surfaces being located at a point below the caddy pincer arms to permit the movable bottom to be pivoted completely out of the way of the caddy cigarette package housing interior.

2. A caddy according to claim 1 wherein said caddy housing and said caddy movable cover are provided with cooperative slide guide surfaces to cause the movable cover to slide with a translational movement when covering and uncovering the top hole, the cover and said actuator surface being adapted for engagement by the thumb of said hand holding the caddy.

3. A caddy according to claim 1 wherein said pivotable detachable surfaces permit said movable bottom to be completely detached from and reinstalled upon said cigarette caddy.

4. A caddy according to claim 1 including a spacer element carried upon said movable bottom for engaging a bottom of a cigarette package of regular length to position the cigarette package top adjacent the caddy housing top.

5. A caddy according to claim 4 including retainer surfaces on said movable bottom and said spacer, the spacer being removable from and replaceable upon said moable caddy bottom.

6. A caddy according to claim 1 wherein said pincer inner surfaces form, substantially, a circular right cylinder interrupted throughout its axial length and over an arc of more than 15° to provide resiliency to said pincer arms.

7. A caddy according to claim 6 wherein said pincer arm outer surfaces flare into the outer surface of the package housing to provide a smooth, easily handled and pocketed caddy.

* * * * *